US011484460B2

(12) United States Patent
Park et al.

(10) Patent No.: US 11,484,460 B2
(45) Date of Patent: Nov. 1, 2022

(54) DAMPING-ADJUSTABLE SHOULDER JOINT TRACKING APPARATUS FOR VARIOUS UPPER EXTREMITY REHABILITATION MODES

(71) Applicants: KOREA ADVANCED INSTITUTE OF SCIENCE AND TECHNOLOGY, Daejeon (KR); National Rehabilitation Center, Seoul (KR)

(72) Inventors: Hyung Soon Park, Daejeon (KR); Kyoung Soub Lee, Daejeon (KR); Hogene Kim, Seoul (KR)

(73) Assignees: KOREA ADVANCED INSTITUTE OF SCIENCE AND TECHNOLOGY, Daejeon (KR); NATIONAL REHABILITATION CENTER, Seoul (KR)

( * ) Notice: Subject to any disclaimer, the term of this patent is extended or adjusted under 35 U.S.C. 154(b) by 817 days.

(21) Appl. No.: 16/347,872

(22) PCT Filed: Sep. 22, 2017

(86) PCT No.: PCT/KR2017/010513
§ 371 (c)(1),
(2) Date: May 7, 2019

(87) PCT Pub. No.: WO2018/093039
PCT Pub. Date: May 24, 2018

(65) Prior Publication Data

US 2019/0269571 A1 Sep. 5, 2019

(30) Foreign Application Priority Data

Nov. 16, 2016 (KR) ..... 10-2016-0152460
Sep. 21, 2017 (KR) ..... 10-2017-0122137

(51) Int. Cl.
*A61H 1/02* (2006.01)
*A61H 1/00* (2006.01)
*A63B 21/02* (2006.01)

(52) U.S. Cl.
CPC ..... *A61H 1/0281* (2013.01); *A61H 1/00* (2013.01); *A61H 1/02* (2013.01); *A61H 1/0274* (2013.01);
(Continued)

(58) Field of Classification Search
CPC ..... A61H 1/00; A61H 1/02; A61H 1/0274; A61H 1/0281; A61H 2201/0165;
(Continued)

(56) References Cited

U.S. PATENT DOCUMENTS 5,015,926 A * 5/1991 Casler ..... A63B 21/00076 482/902
5,569,120 A * 10/1996 Anjanappa ..... A63B 24/00 482/4
(Continued)

FOREIGN PATENT DOCUMENTS

CN 102258849 A * 11/2011
JP 2000279463 A * 10/2000
(Continued)

OTHER PUBLICATIONS

KIPO, A PCT Search Report & Written Opinion of PCT/KR2017/010513 dated Apr. 18, 2018.
(Continued)

*Primary Examiner* — Justine R Yu
*Assistant Examiner* — Alexander Morales
(74) *Attorney, Agent, or Firm* — Lex IP Meister, PLLC

(57) ABSTRACT

A shoulder joint tracking apparatus includes a gravity compensation spring that compensates for a vertical movement of a shoulder joint of a trainee, a weight of an arm, and
(Continued)

gravity to a weight of a rehabilitation exercise device attached to the arm, and a shoulder joint tracking device that is provided at one side of the shoulder rehabilitation apparatus, is connected to the gravity compensation spring, and applies a damping force corresponding to a force applied by the trainee, in a direction opposite to a direction in which the force is applied, to control a vertical movement of the shoulder rehabilitation apparatus.

9 Claims, 8 Drawing Sheets

(52) U.S. Cl.
CPC ..... *A63B 21/02* (2013.01); *A61H 2201/0165* (2013.01); *A61H 2201/1215* (2013.01); *A61H 2201/149* (2013.01); *A61H 2201/165* (2013.01); *A61H 2201/1664* (2013.01); *A61H 2201/5053* (2013.01); *A61H 2205/062* (2013.01)

(58) Field of Classification Search
CPC ..... A61H 2201/1215; A61H 2201/149; A61H 2201/165; A61H 2201/1664; A61H 2201/5053; A61H 2205/062; A63B 21/02; A63B 21/0428; A63B 21/0057
See application file for complete search history.

(56) References Cited

U.S. PATENT DOCUMENTS

| | | | | |
|---|---|---|---|---|
| 7,976,444 | B2 * | 7/2011 | Binns | A61H 1/0281 482/904 |
| 8,251,879 | B2 * | 8/2012 | Binns | A61H 1/0281 482/904 |
| 8,317,730 | B2 * | 11/2012 | Zhang | A61F 5/0102 600/595 |
| 8,641,782 | B2 | 2/2014 | Kim et al. | |
| 8,905,950 | B2 * | 12/2014 | Bonutti | A61H 1/0274 128/845 |
| 9,403,056 | B2 * | 8/2016 | Weinberg | A63B 21/4045 |
| 10,130,546 | B2 * | 11/2018 | Townsend | A63B 24/00 482/4 |

FOREIGN PATENT DOCUMENTS

| | | |
|---|---|---|
| JP | 2008-237804 | 10/2008 |
| JP | 4481089 | 6/2010 |
| JP | 2014-226441 | 12/2014 |
| JP | 6210363 | 10/2017 |
| KR | 10-2010-0069293 | 6/2010 |
| KR | 10-2011-0066567 | 6/2011 |
| KR | 10-2011-0080656 | 7/2011 |
| KR | 10-2012-0015704 | 2/2012 |
| KR | 10-2012-0119738 | 10/2012 |
| KR | 10-2015-0113254 | 10/2015 |
| KR | 10-2016-0036279 | 4/2016 |

OTHER PUBLICATIONS

Jeong-Ho Park et al., "Development of a Passive Shoulder Joint Tracking Device for Rehabilitation of Natural Arm Motions with a Robot", KSME 2015 Annual Meeting, pp. 2132-2135, Nov. 2015.
Arno H. A. Stienen et al., "Dampace: Design of an Exoskeleton for Force-Coordination Training in Upper-Extremity Rehabilitation", Journal of Medical Devices, vol. 3 , Sep. 2009.
Seung-Mo Jeong et al., "Design of a Variable Damping Mechanism for Shoulder Joint Tracking Device", 2017 14th International Conference on Ubiquitous Robots and Ambient Intelligence (URAI), Maison Glad Jeju, Jeju, Korea, Jun. 28-Jul. 1, 2017.
Jeong-Ho Park et al., "Development of Low-end Robot System for Comprehensive Shoulder Rehabilitation", 13th International Conference on Ubiquitous Robots and Ambient Intelligence (URAI 2016) in Xi'an, China, Aug. 19-22, 2016.
Kyoung-Soub Lee et al., "Design of a variable damping shoulder tracking mechanism for various control modes", The 8th Annual Conference of Korea Society of Medical Robot, Seoul, Korea, Republic of, Sep. 2, 2017.
Kyoung-Soub Lee et al., "Design and experimental validation of the shoulder tracking mechanism for shoulder rehabilitation", History and future of Rehabilitation Robotics in Dong-Eui University, Korea, Republic of, Sep. 23-24, 2016.
Seung-Mo Jeong et al., "Design of a variable damping mechanism for shoulder joint tracking device", 2017 14th International Conference on Ubiquitous Robots and Ambient Intelligence (URAI) in Jeju, Korea, Republic of, Jun. 28, 2017.

* cited by examiner

DAMPING-ADJUSTABLE SHOULDER JOINT TRACKING APPARATUS FOR VARIOUS UPPER EXTREMITY REHABILITATION MODES

TECHNICAL FIELD

The present invention relates to a damping-adjustable shoulder tracking apparatus for various upper extremity rehabilitation modes.

BACKGROUND ART

With the recent increase in the number of patients suffering from various shoulder joint diseases, the demand and interest in shoulder rehabilitation are increased. Generally, the shoulder can be rehabilitated by lifting the shoulder or supporting the strength of the shoulder by using an elastic band, by using an upper extremity rehabilitation device such as a continuous passive motion (CPM) device which is used in most hospitals. Use of this method requires a separate high frame in addition to the rehabilitation device, which is troublesome.

Another method of the shoulder rehabilitation is to constrain and rehabilitate the motion of the shoulder joint by using the upper extremity rehabilitation device. This shoulder rehabilitation method constrains the motion of the shoulder joint thereby limiting a range of motion. In addition, if axes of the joint and the upper extremity rehabilitation device do not match each other, force may be applied to each joint, which may cause a shoulder pain and cause long-term damage. Accordingly, an actuator can be used to move the shoulder, but the actuator is bulky and expensive, which makes it difficult to use and maintain the actuator in the hospital or clinical field.

To address this issue, there has been studied a method of rehabilitating the shoulder joint using a passive rehabilitation device that is combined to a general upper extremity rehabilitation assistant device having no shoulder joint tracking function and supports the upper extremity rehabilitation assist device by using a spring. However, since this rehabilitation assistant device can be applied only to a light upper extremity robot device within 10 kg, there is a problem that the range of use is limited.

In addition, it cannot track a positional change the shoulder joint in a three-dimensional space according to the movement of the scapular and upper body, thereby causing the shoulder joint to be damaged according to the movement posture of the upper extremity. Furthermore, when a patient who is rehabilitated by using the existing rehabilitation assistant device, i.e., a trainee, exercises by applying a force to the device in an active exercise mode, the tracking performance of the shoulder joint can be deteriorated due to the excessive movement of the rehabilitation assistant device.

SUMMARY OF THE INVENTION

Technical Problem

Accordingly, the present invention provides a shoulder joint tracking apparatus provided with a variable damper capable of applying a variable damping force depending on a situation while performing gravity compensation for a rehabilitation assistance device.

Technical Solution

A damping-adjustable shoulder joint tracking apparatus according to an aspect of the present invention includes a gravity compensation spring and a shoulder joint tracking device. The gravity compensation spring is provided at a first point of a shoulder rehabilitation apparatus, and compensates for a vertical movement of a shoulder joint of a trainee, a weight of an arm, and gravity to a weight of a rehabilitation exercise device attached to the arm. The shoulder joint tracking device is provided at a second point of the shoulder rehabilitation apparatus, is connected to the gravity compensation spring, and applies a damping force corresponding to a force applied by the trainee, in a direction opposite to a direction in which the force is applied, to control a vertical movement of the shoulder rehabilitation apparatus.

The shoulder joint tracking device may include a rotary damper that changes a resistance magnitude according to a rotation speed, and a magnetic clutch that controls whether to transmit the damping force applied to the shoulder rehabilitation apparatus in the direction opposite to the direction in which the force of the trainee is applied.

The shoulder joint tracking device may further include a first coupler that connects the gravity compensating spring to a first shaft included within a spring shaft provided in the gravity compensation spring, a second coupler that is provided at a first side of the magnetic clutch and connects the first shaft and the second shaft, and a third coupler that connects the rotary damper and a third shaft connected to a second side of the magnetic clutch.

The magnetic clutch may include a clutch coil that is an electromagnet which connects the second shaft and the third shaft when power is supplied to the magnetic clutch, and a friction plate that generates a frictional force when the second shaft and the third shaft are connected by the clutch coil. The magnetic clutch may be divided into a first portion to which the second shaft is connected and a second portion to which the third shaft is connected.

The shoulder rehabilitation apparatus provided with the shoulder joint tracking device may include a vertical frame formed vertically on ground, a horizontal frame connected to the vertical frame at an angle of 90 degrees to be horizontal to the ground, a first linear motion (LM) guide that is provided at a position opposite to the vertical frame provided with the gravity compensating spring and compensates for a vertical movement according to a motion of the shoulder joint of the trainee, a compensation load transmitting cable that connects the gravity compensating spring and the first LM guide, and a second LM guide that compensates for a horizontal movement of the first shoulder joint according to an arm motion of the trainee. The shoulder joint tracking device may be provided at a position where the horizontal frame and the vertical frame are in contact.

A damping-adjustable shoulder joint tracking apparatus according to another aspect of the present invention includes a gravity compensation spring, a vertical shoulder joint tracking device, and a horizontal shoulder joint tracking device. The gravity compensation spring is provided at a first point of a shoulder rehabilitation apparatus, and compensates for a vertical movement of a shoulder joint of a trainee, a weight of an arm, and gravity to a weight of a rehabilitation exercise device attached to the arm. The vertical shoulder joint tracking device is provided at a second point of the shoulder rehabilitation apparatus, is connected to the gravity compensation spring, and transmits damping in a vertical direction to the shoulder rehabilitation apparatus. The horizontal shoulder joint tracking device is provided at a third point of the shoulder rehabilitation apparatus and transmits damping in a first direction and second direction to the shoulder rehabilitation apparatus.

The horizontal shoulder joint tracking device may include a first shoulder joint tracking device that is provided at a first direction LM guide of the shoulder rehabilitation apparatus and transmits the damping in the first direction, and a second shoulder joint tracking device that is provided at a second direction LM guide of the shoulder rehabilitation apparatus and transmits the damping in the second direction. The shoulder rehabilitation apparatus may include a vertical frame formed vertically on ground, a horizontal frame connected to the vertical frame at an angle of 90 degrees to be horizontal to the ground, the first direction LM guide that is provided at one side of the vertical frame which is not provided with the vertical shoulder joint tracking device, and compensates for a movement in the first direction of the shoulder joint of the trainee, and the second direction LM guide that is provided in a direction of 90 degrees to the first direction LM guide, and compensates for a movement in the second direction of the shoulder joint of the trainee.

Each of the first shoulder joint tracking device and the second shoulder joint tracking device may include a rotary damper that changes a resistance magnitude according to a rotation speed, a magnetic clutch that controls whether to transmit a damping force applied to the shoulder rehabilitation apparatus in a direction opposite to a direction in which a force of the trainee is applied, and a timing belt that is connected to the magnetic clutch through a first shaft and converts a force of the rotary damper in a linear direction.

Each of the first shoulder joint tracking device and the second shoulder joint tracking device may further include a coupler that connects the rotary damper to a second shaft connected to the magnetic clutch, and a pulley that fixes one side of the timing belt to the first direction LM guide or the second direction LM guide.

The vertical shoulder joint tracking device may include a rotary damper that changes a resistance magnitude according to a rotation speed, a first coupler that connects the gravity compensating spring to a first shaft included within a spring shaft provided in the gravity compensation spring, a second coupler that is provided at a first side of the magnetic clutch and connects the first shaft and the second shaft, and a third coupler that connects the rotary damper and a third shaft connected to a second side of the magnetic clutch.

Effects of the Invention

According to the present invention, in an active exercise mode, a magnetic clutch is activated to operate a gravity compensation spring and a shoulder joint tracking device to which a damping force is applied simultaneously, so that gravity can be easily compensated through the gravity compensation spring and a motion of a shoulder joint can be easily tracked by using the shoulder joint tracking device.

Further, since damping is inactivated in a passive exercise mode, a constant gravity compensation force can be provided to the gravity compensation spring through the shoulder joint tracking device having only the gravity and the gravity compensation force.

Furthermore, it is possible to reduce a pain caused by shoulder dislocation due to weakened shoulder muscles of the trainee and improve the effectiveness of the rehabilitation exercise by assisting the motion of the arm.

DETAILED DESCRIPTION OF THE EMBODIMENTS

Figure 1:
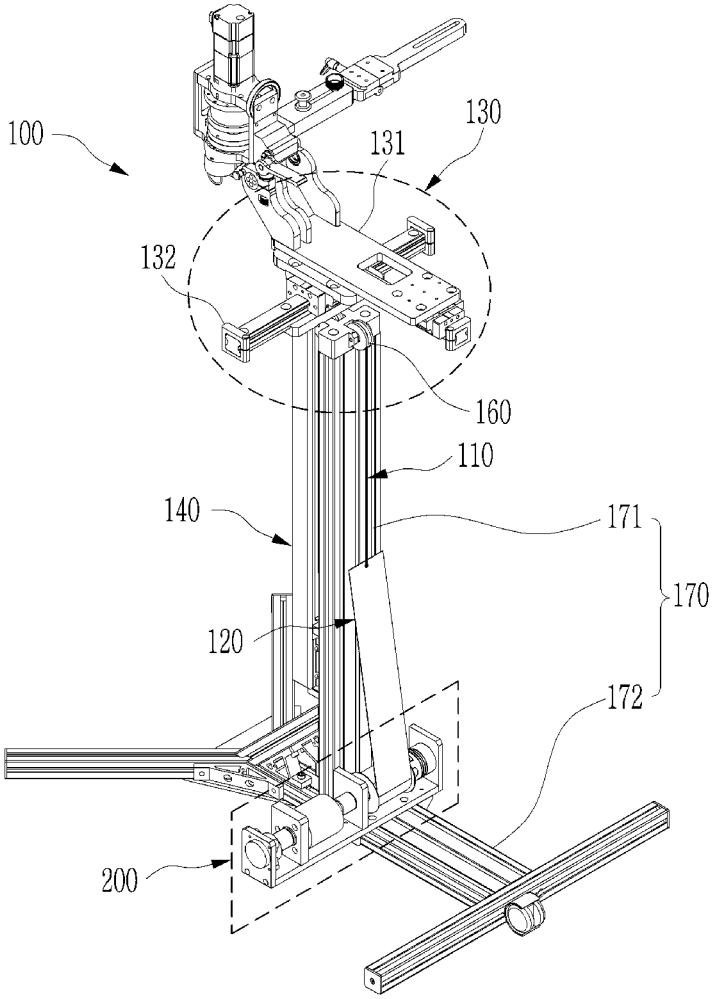
FIG. 1 is an exemplary diagram showing a shoulder rehabilitation apparatus including a shoulder joint tracking device according to a first embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" or "include" is understood to imply the inclusion of stated elements but not the exclusion of any other elements.

A shoulder rehabilitation apparatus provides five rehabilitation modes: a passive stretching mode, an assistive activity exercise mode, a resistive active exercise mode, an isokinetic strengthening mode, and an isometric strengthening mode at a fixed posture according to symptoms of a trainee under rehabilitation treatment. Here, except for the passive stretching mode, the trainee applies a force to the shoulder rehabilitation apparatus, and thus an excessive movement (vertical movement or horizontal movement) arises in the shoulder rehabilitation apparatus due to the force of the trainee.

Therefore, an embodiment of the present invention provides a shoulder rehabilitation apparatus including a shoulder joint tracking device, so that damping is applied so that excessive movement does not arise in the shoulder rehabilitation apparatus even when the trainee applies the force.

Hereinafter, a damping-adjustable shoulder joint tracking apparatus according to an embodiment of the present invention is described with reference to the drawings. In an embodiment of the present invention, a shoulder rehabilitation apparatus that is a whole apparatus is described as an example for convenience of explanation.

Figure 2:
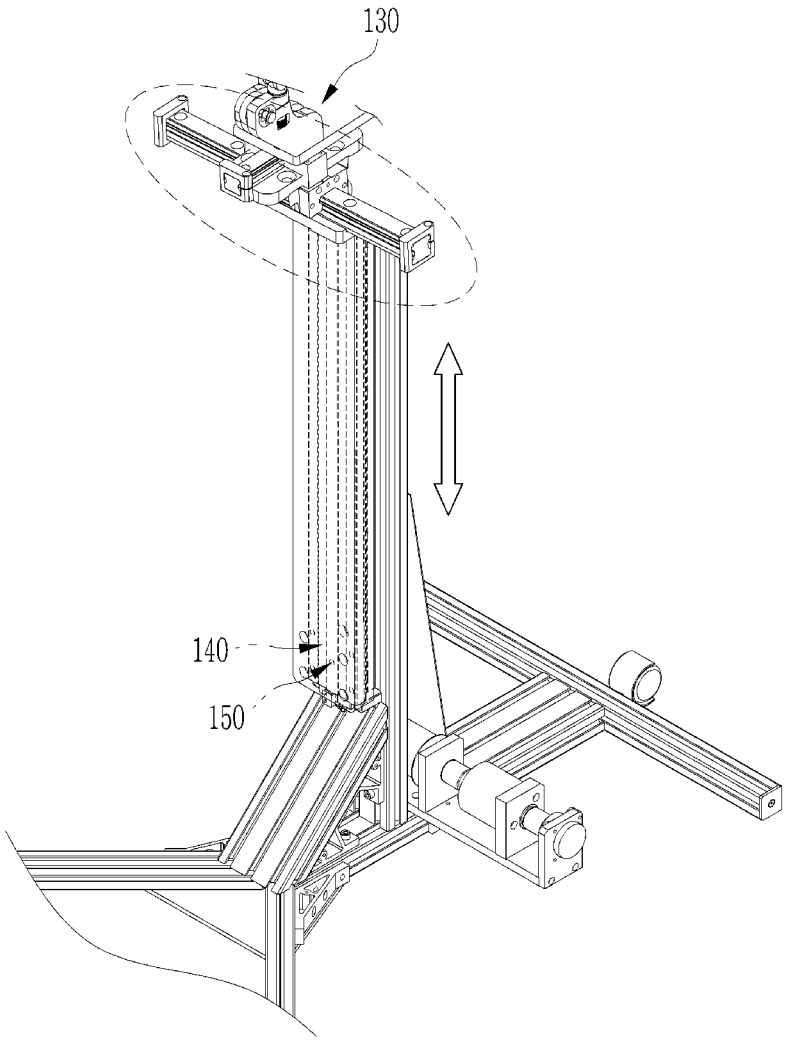
FIG. 2 is an exemplary diagram showing a shoulder rehabilitation apparatus according to a first embodiment of the present invention at another angle.

FIG. 1 is an exemplary diagram showing a shoulder rehabilitation apparatus including a shoulder joint tracking device according to a first embodiment of the present invention, and FIG. 2 is an exemplary diagram showing a shoulder rehabilitation apparatus according to a first embodiment of the present invention at another angle.

As shown in FIG. 1, a first linear motion (LM) guide 130 is provided at an upper end of a shoulder rehabilitation apparatus 100 to compensate for a movement in a first direction and a movement in a second direction of a trainee's shoulder joint. It is shown as an example that the first LM guide 130 includes a first direction LM guide 131 for compensating the movement in the first direction of the shoulder joint on an XY table for compensating horizontal movements of the shoulder joint according to an arm motion and a second direction LM guide 132 for compensating for the movement in the second direction of the shoulder joint.

A method of compensating the movement of the shoulder joint by the first LM guide 130 can be performed by various methods, and therefore, the description is not limited to any one method. The first direction and the second direction mean an X direction and a Y direction in the horizontal direction, respectively, and do not correspond to a vertical direction.

The first direction LM guide 131 is formed by using one LM guide having a constant load instead of the conventional two LM guides. Accordingly, it is possible to solve the problem of misalignment and friction occurring when the conventional two LM guides are used.

In addition, the second direction LM guide 132 is formed by reducing a length from a conventional length of 640 mm to a predetermined length. It is described as an example in an embodiment of the present invention that the second direction LM guide 132 having 360 mm is provided, but the present invention is not limited thereto. Here, since functions of the first direction LM guide 131 and the second direction LM guide 132 are already known, a detailed description thereof is omitted in an embodiment of the present invention.

A compensation load transmitting cable 110 of the shoulder rehabilitation apparatus 100 connects the second LM guide 140 and a gravity compensation spring 120. One side of the compensation load transmitting cable 110 is connected to a cable fixing unit 150 provided on the second LM guide 140 and its other side is connected to one side of the gravity compensating spring 120.

The portion of the compensation load transmitting cable 110 connected to the cable fixing unit 150 is connected to a first pulley (not shown), and the portion of the compensation load transmitting cable 110 connected to the gravity compensating spring 120 is connected to a second pulley 160. The first pulley is spaced apart from the second pulley 160 by a predetermined distance. A length of the compensation load transmitting cable 110 is kept constant and the length is not limited to any one value.

The gravity compensating spring 120 compensates for a vertical movement of the shoulder joint of the trainee, a weight of the trainee's arm, and gravity to a weight of the rehabilitation apparatus attached to the arm. It is described as an example in an embodiment of the present invention that a constant load spring is used as the gravity compensation spring 120.

A general tensile spring increases a return force in proportion to a tensile length due to the characteristics of the spring. On the other hand, the constant load spring is advantageous in that there is no change in gravity compensation load since the return force is constant regardless of the tension length when the spring is extended.

In order for the gravity compensating spring 120 to compensate for the gravity, a compensating force should act in an opposite direction to the gravity. When the gravity compensation spring 120 is disposed at the upper end of the shoulder rehabilitation apparatus 100, a problem that the size of the shoulder rehabilitation apparatus 100 becomes large may occur.

Therefore, it is described an example in which the compensation load transmitting cable 110 and the plurality of pulleys are used to convert an acting direction of the compensating force into the opposite direction to the gravity, and the gravity compensating spring 120 is arranged on a vertical frame 171 under the shoulder rehabilitation apparatus 100. Here, since a method of converting the acting direction of the compensating force into the opposite direction to the gravity by the pulley is already known, a detailed description thereof is omitted in an embodiment of the present invention.

A gravity compensation load compensated by the gravity compensating spring 120 is determined by a sum of the arm weight of the trainee and the weight of the rehabilitation apparatus (not shown) worn by the trainee. Here, when the trainee moves down the arm to the ground, a length of the gravity compensation spring 120 increases, and thus the second LM guide 140 rises upward. Conversely, when the trainee raises the arm, the length of the gravity compensation spring 120 decreases, and thus the second LM guide 140 descends.

A frame 170 includes the vertical frame 171 vertically formed on the ground and a horizontal frame 172 that is connected to the vertical frame 171 at an angle of 90 degrees and is horizontally aligned with the ground. In an embodiment of the present invention, a width of the vertical frame 171 is increased by a predetermined value to improve rigidity. Further, because the gravity compensating spring 120 is disposed on the vertical frame 171, a load moment acting on the lower horizontal frame 172 is decreased.

The second LM guide 140 is fixedly mounted on the vertical frame 171 which is an axial direction of the shoulder rehabilitation apparatus 100, and tracks the joint through the vertical movement. Since a function of the second LM guide 140 is already known, a detailed description thereof is omitted in an embodiment of the present invention. While the second LM guide 140 is described as an example in an embodiment of the present invention, a linear bush may be used.

The cable fixing unit 150 is provided on one side of the second LM guide 140. One side of the compensation load transmitting cable 110 is fixed to the cable fixing unit 150. The cable fixing unit 150 also moves up and down in accordance with the movement of the second LM guide 140 so that the length of the compensation load transmission cable 110 from the cable fixing unit 150 to the first pulley can be adjusted.

The pulley 160 is mounted on the upper end of the vertical frame 171, that is, the upper end opposite to a position where the vertical frame 171 and the horizontal frame 172 are connected. While the two pulleys, i.e., the first pulley and the second pulley 160 are provided in an embodiment of the present invention, the present invention is not limited thereto.

The first pulley is provided on the vertical frame 171 in the same direction as the second LM guide 140, and the second pulley 160 is mounted on a vertical upper end of a position where the gravity compensating spring 120 is installed. It is described as an example that the first pulley and the second pulley 160 are provided behind the frame 171, in order to reduce a volume increased by installation of the gravity compensating spring 120 and improve stability of the shoulder rehabilitation apparatus 100.

The first pulley and the second pulley 160 function to change a direction of a force applied by the gravity compensating spring 120. Since the direction of the force of the gravity compensating spring 120 acts in a downward direction of the shoulder rehabilitation apparatus 100, the pulley and the compensation load transmitting cable 110 are used together, in order to apply the force of the gravity compensating spring 120 in an upward direction being opposite to the direction of gravity.

It is described as an example that the first pulley and the second pulley 160 have the same radius. An interval between the first pulley and the second pulley 160 is not limited to any one value.

A shoulder joint tracking device 200 is provided at a lower end of the shoulder rehabilitation apparatus 100, that is, at a position where the horizontal frame 172 and the vertical frame 171 are in contact. The shoulder joint tracking device 200 applies a damping force to the shoulder rehabilitation apparatus 100. That is, the shoulder joint tracking device 200 applies the damping force corresponding to the force applied by the trainee in a direction opposite to a direction in which the force is applied. This is to suppress the shoulder rehabilitation apparatus 100 from moving in the vertical direction more excessively than the trainee's shoulder movement by the force of the trainee. A structure of the shoulder joint tracking device 200 is described with reference to FIG. 3.

Figure 3:
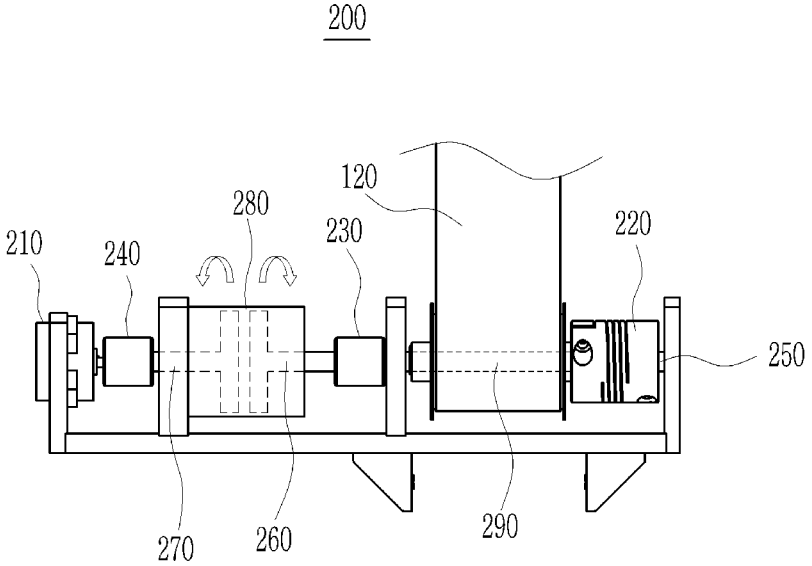
FIG. 3 is a structural diagram showing a shoulder joint tracking device according to a first embodiment of the present invention.

FIG. 3 is a structural diagram showing a shoulder joint tracking device according to a first embodiment of the present invention.

As shown in FIG. 3, a shoulder joint tracking device 200 includes a rotary damper 210 for changing a resistance magnitude according to a rotation speed and a magnetic clutch 280 for controlling whether to transmit a damping force to be applied to the shoulder rehabilitation apparatus 100 depending on whether power is supplied. Since the gravity compensation spring 120, the rotary damper 210, and the magnetic clutch 280 are rotational devices, a plurality of couplers 220 to 240 are provided so that axes of the rotary damper 210 and the magnetic clutch 280 are aligned and attached in a line for structural simplicity.

The first coupler 220 couples the gravity compensating spring 120 to a first shaft 250 so that the gravity compensating spring 120 is connected to the first shaft 250. Here, the first shaft 250 is a shaft provided within a spring shaft 290 provided in the gravity compensation spring 120.

Thus, the first shaft 250 rotates together with the spring shaft 290 provided in the gravity compensation spring 120 when the rehabilitation apparatus worn by the trainee moves vertically. The spring shaft 290 rotates to allow the gravity compensation spring 120 to be wound and thus to transmit the gravity compensation load to the shoulder rehabilitation apparatus 100 while allowing vertical movement of the shoulder rehabilitation apparatus 100.

The second coupler 230 is located on a first side of the magnetic clutch 280 and combines the first shaft 250 and a second shaft 260 in a connected state. The second shaft 260 is formed between the first side of the magnetic clutch 280 and the second coupler 230.

The third coupler 240 located on a second side of the magnetic clutch 280 combines a third shaft 270 with the rotary damper 210 whose resistance varies according to the rotation speed. Accordingly, the third coupler 240 rotates under the influence of the rotary damper 210, by receiving the resistance force proportional to the rotation speed. The third shaft 270 is formed between the third coupler 240 and the second side of the magnetic clutch 280.

The magnetic clutch 280 is composed of a clutch coil, a rotor coupler, and an armature shaft. The magnetic clutch 280 is divided into two portions, the first portion being a portion in which the second shaft 260 is implemented and the second portion being a portion where the third shaft 270 is implemented. A friction plate (not shown) is included between the second shaft 260 and the third shaft 270.

When the power is not supplied to the magnetic clutch 280, the second shaft 260 and the third shaft 270 are not connected and rotate independently. However, when the power is supplied to the magnetic clutch 280 and thus a current flows, the clutch coil becomes an electromagnet and induces the second shaft 260 and the third shaft 270 to come in contact. As a result, a frictional force is generated due to the friction plate, and the first portion and the second portion rotate together at the same speed and in the same direction. Since a method of driving the magnetic clutch 280 is already known, a detailed description thereof is omitted in an embodiment of the present invention.

Since the two shafts, i.e., the second shaft 260 and the third shaft 270, rotate at the same speed when the power is supplied to the magnetic clutch 280, the damping applied on the third shaft 270 is transmitted to the second shaft 260, and consequently, the excessive vertical movement of the shoulder rehabilitation apparatus 100, which is caused by the force applied by the trainee, is suppressed.

A method of suppressing motion in the shoulder rehabilitation apparatus 100 in accordance with whether the shoulder joint tracking device 200 is operated is described with reference to FIG. 4.

Figure 4:
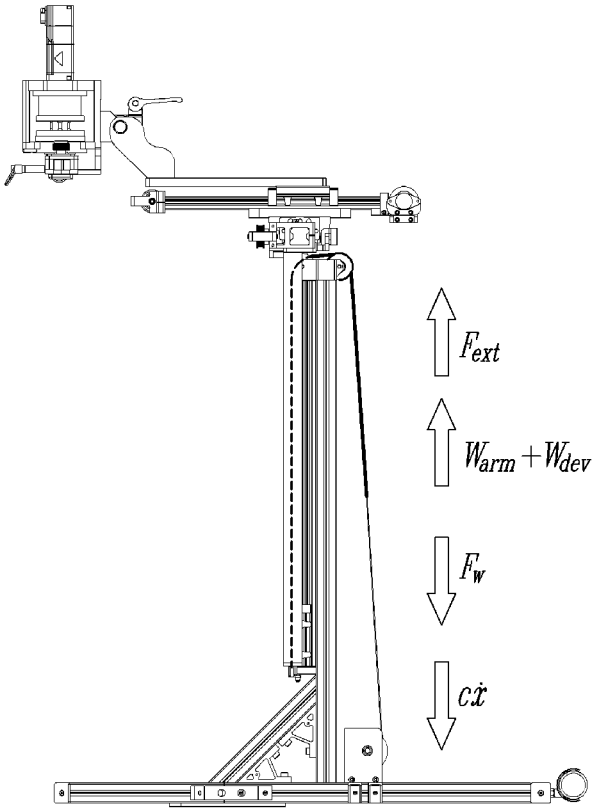
FIG. 4 is an exemplary diagram for explaining motion suppression of a shoulder rehabilitation apparatus according to an embodiment of the present invention.

FIG. 4 is an exemplary diagram for explaining motion suppression of a shoulder rehabilitation apparatus according to an embodiment of the present invention.

Since the power is not supplied to the magnetic clutch 280 when the trainee performs the joint motion in a passive exercise mode, only the first shaft 250 and the second shaft 260 rotate. In this case, since the rotary damper 210 is not connected to the shaft, the shoulder joint is tracked by a general method without adding any extra force to the shoulder rehabilitation apparatus 100. This is shown as arrows indicated by $W_{arm}+W_{dev}$ and $F_w$ in FIG. 4, where $W_{arm}$ is the weight of the arm, $W_{dev}$ is the weight of the rehabilitation apparatus wornby the trainee, and $F_w$ is the weight supporting force.

However, in a case of exercise modes other than the passive joint exercise, that is, exercise modes in which the force of the trainee is added, the magnetic clutch 280 may be activated to provide a damping effect to the shoulder rehabilitation apparatus 100. That is, when the power is supplied to the magnetic clutch 280 and thus a current flows, the third shaft 270 is connected to the second shaft 260.

The third shaft 270 rotates under a resistance force proportional to the rotation speed by the influence of the rotary damper 210 so that the second shaft 260 also rotates under the same resistance force as the third shaft 270. As a result, damping is applied to the entire shoulder rehabilitation apparatus 100 so that the shoulder joint tracking device 200 can suppress an excessive vertical movement of the shoulder rehabilitation apparatus 100 even if the trainee applies the force.

This is shown as arrows indicated by $F_{ext}$ and $c\dot{x}$ in FIG. 4, where $F_{ext}$ is the external force of the trainee and $c\dot{x}$ is the added damping force. Further, c is a damping coefficient, and $\dot{x}$ is the vertical speed of the shoulder rehabilitation apparatus. A relationship among $F_w$, $c\dot{x}$, $W_{arm}$, and $W_{dev}$ is as shown in the following Equation 1.

$$F_w+c\dot{x}=W_{arm}+W_{dev}F_{ext} \quad \text{Equation 1}$$

Here, $F_w$ is a compensation force of the gravity compensation spring 120 and is calculated as $F_w=W_{arm}+W_{dev}$.

Since the left parameter ($F_w+c\dot{x}$) and the right parameter ($W_{arm}+W_{dev}+F_{ext}$) are in equilibrium through Equation 1, the shoulder rehabilitation apparatus 100, the excessive movement in the vertical direction is suppressed so that the shoulder joint of the trainee can be easily tracked even if the trainee adds the force.

In the first embodiment described above, an example in which the shoulder joint tracking device 200 further applies damping in the vertical direction of the shoulder rehabilitation apparatus 100 has been described. Next, a shoulder rehabilitation apparatus for applying damping in the vertical direction and the horizontal direction is described with reference to FIG. 5 to FIG. 7.

Figure 5:
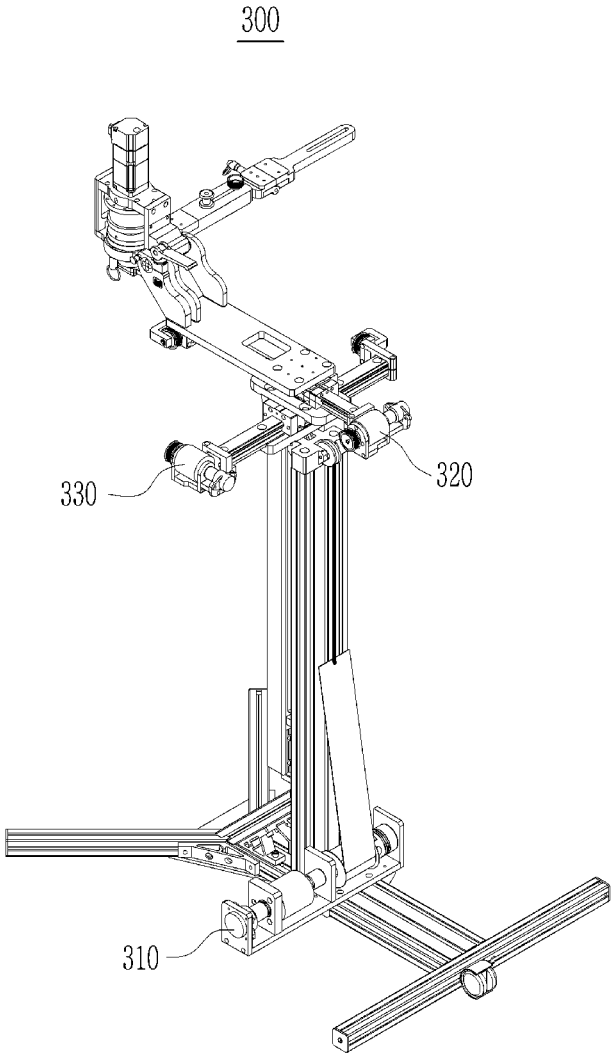
FIG. 5 is an exemplary diagram showing a shoulder rehabilitation apparatus including a shoulder joint tracking device according to a second embodiment of the present invention.

FIG. 5 is an exemplary diagram showing a shoulder rehabilitation apparatus including a shoulder joint tracking device according to a second embodiment of the present invention.

As shown in FIG. 5, a shoulder rehabilitation apparatus 300 according to another embodiment of the present invention omits the shoulder joint tracking device 200 in the shoulder rehabilitation apparatus 100 described with reference to FIG. 1, and further includes a first shoulder joint tracking device 310, a second shoulder joint tracking device 320, and a third shoulder joint tracking device 330.

Here, the first shoulder joint tracking device 310 functions to transmit damping in the vertical direction and is referred to as a vertical shoulder joint tracking device. In the structure of FIG. 1, the first shoulder joint tracking device 310 is provided at a position where the horizontal frame 172 and the vertical frame 171 are in contact. The second shoulder joint tracking device 320 functions to transmit damping in the first direction, and the third shoulder joint tracking device 330 functions to transmit damping in the second direction. The second shoulder joint tracking device 320 and the third shoulder joint tracking device 330 are collectively referred to as a horizontal shoulder joint tracking device. The second shoulder joint tracking device 320 is provided at one side of the first direction LM guide 131, and the third shoulder joint tracking device 330 is provided at one side of the second direction LM guide 132.

The horizontal shoulder joint tracking device is provided at the upper end of the shoulder rehabilitation apparatus 300, and the vertical shoulder joint tracking device is provided at the lower end of the shoulder rehabilitation apparatus 300 and is spaced apart from the horizontal shoulder joint tracking device by a predetermined distance.

When the shoulder rehabilitation apparatus 300 according to the second embodiment of the present invention is used, the damping in three directions can be changed by tracking the movement of the shoulder joint according to the needs of the trainee. A structure of the first shoulder joint tracking device 310, which is the vertical shoulder joint tracking device, is the same as that shown in FIG. 3

A structure of the horizontal shoulder joint tracking device is described with reference to FIG. 6 and FIG. 7.

Figure 6:
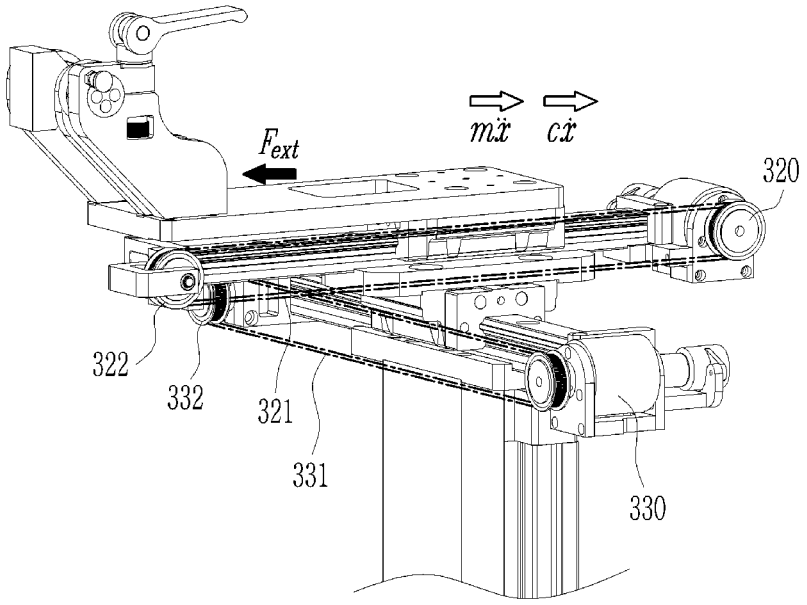
FIG. 6 is an exemplary diagram showing a horizontal shoulder joint tracking device according to a second embodiment of the present invention.
Figure 7:
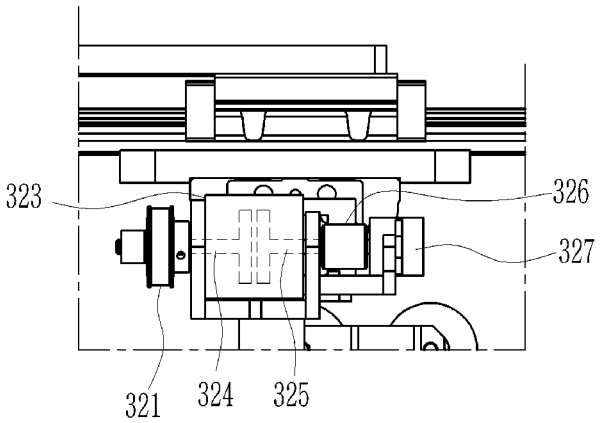
FIG. 7 is an exemplary diagram showing a horizontal shoulder joint tracking device according to a second embodiment of the present invention at another angle.

FIG. 6 is an exemplary diagram showing a horizontal shoulder joint tracking device according to a second embodiment of the present invention, and FIG. 7 is an exemplary diagram showing a horizontal shoulder joint tracking device according to a second embodiment of the present invention at another angle.

In FIG. 7, the second shoulder joint tracking device 320 is described as an example for convenience of explanation, and the third shoulder joint tracking device 330 has the same structure as the second shoulder joint tracking device 320. The second shoulder joint tracking device 320 includes a rotary damper 327 for changing a resistance magnitude according to a rotation speed and a magnetic clutch 323 for controlling whether to transmit a damping force to be applied to the shoulder rehabilitation apparatus depending on whether power is supplied. One side of a first shaft 324 is connected to the magnetic clutch 323 and the other side of the first shaft 324 is connected to a timing belt 321. The coupler 326 couples the rotary damper 327 and the second shaft 325.

Pulleys 322 and 332 are located at one ends of timing belts 321 and 331, that is, at ends of the first direction LM guide 131 and second direction LM guide 132, and one portions of the timing belts 321 and 331 are fixed to the first direction LM guide 131 or the second direction LM guide 132. Here, the first direction LM guide 131 may be provided with a connecting member to which a commercial rehabilitation apparatus attached to the arm of the trainee can be connected. A material of the timing belts 321 and 331 and pulleys 322 and 332 are not limited to any one material.

In a case of the horizontal shoulder joint tracking device, when the power is supplied to the magnetic clutch 323 and thus a current flows, the two shafts 324 and 325 contact a friction plate and rotate at the same speed. Accordingly, when the current flows in the magnetic clutch 323, the force of the rotary damper 327 is transmitted to the entire shoulder rehabilitation apparatus 300 through the two shafts 324 and 325 and the timing belt 321.

Here, the timing belt 321 serves to convert the force of the rotary damper 327 in a linear direction and transmit it. Since the function of the timing belt 321 for converting the force of the rotary damper 327 in the linear direction is known in various manners, a detailed description thereof is omitted in an embodiment of the present invention.

When the trainee performs the passive exercise through the shoulder rehabilitation apparatus 300, the weights of the trainee's upper extremity and the rehabilitation apparatus worn by the trainee are transmitted to the shoulder rehabilitation apparatus 300. In this case, the force appearing between the shoulder rehabilitation apparatus 300 and the rehabilitation apparatus causes the shoulder rehabilitation apparatus 300 to naturally move along the shoulder joint of the trainee.

However, when the trainee applies the force to the device to perform rehabilitation, the rotary damper generates a force proportional to a speed at which the trainee moves for the rehabilitation. Since an acceleration generated by the force of the trainee is generated more excessively than the movement caused by the motion of the shoulder joint, a positional change due to the external force $F_{ext}$ can be suppressed as in the below Equation 2.

$$F_{ext}=m\ddot{x}+c\dot{x} \quad \text{Equation 2}$$

Here, $F_{ext}$ is the external force of the trainee, m is the mass of the rehabilitation apparatus and the shoulder rehabilitation apparatus, c is the damping coefficient, X is the speed of the shoulder rehabilitation apparatus, and $\ddot{x}$ is the acceleration of the shoulder rehabilitation apparatus.

Figure 8:
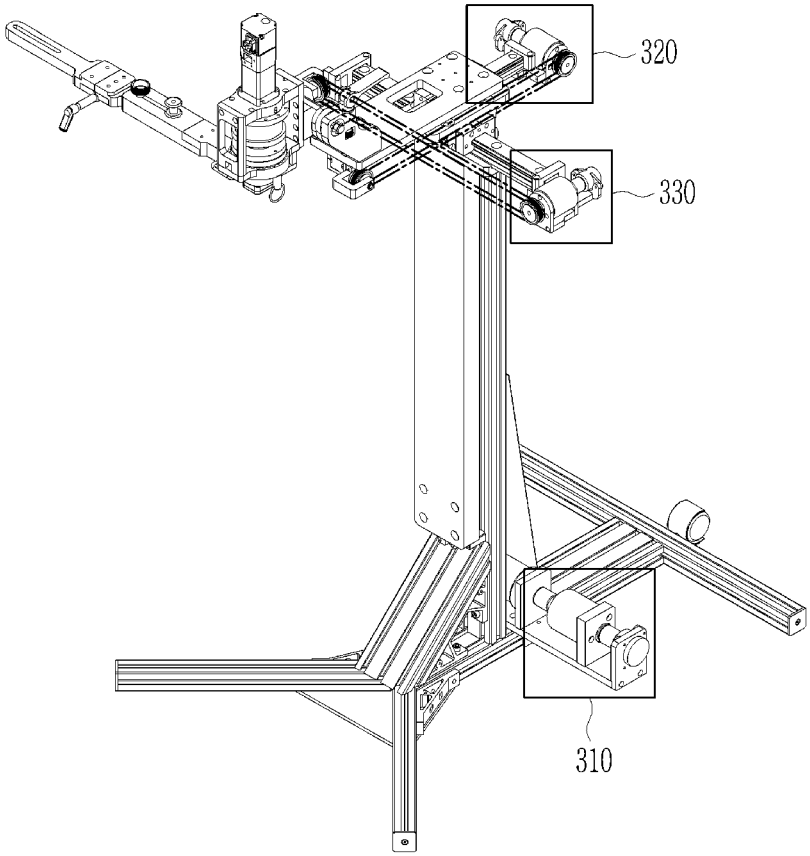
FIG. 8 is an exemplary diagram showing a shoulder rehabilitation apparatus according to a second embodiment of the present invention.

FIG. 8 is an exemplary diagram showing a shoulder rehabilitation apparatus according to a second embodiment of the present invention.

As shown in FIG. 8, the shoulder rehabilitation apparatus 300 is provided with three shoulder joint tracking devices 310, 320, and 330 so that damping in three directions can be changed. Accordingly, when the trainee exercises with the force, the excessive movement of the shoulder rehabilitation apparatus 300 caused by the force applied by the trainee can be suppressed.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A damping-adjustable shoulder joint tracking apparatus comprising:

a gravity compensation spring that is provided at a first point of a shoulder rehabilitation apparatus, and compensates for a vertical movement of a shoulder joint of a trainee, a weight of an arm, and gravity to a weight of a rehabilitation exercise device attached to the arm; and a damping force applying device that is provided at a second point of the shoulder rehabilitation apparatus, is connected to the gravity compensation spring, and applies a damping force corresponding to a force applied by the trainee, in a direction opposite to a direction in which the force is applied, to control a vertical movement of the shoulder rehabilitation apparatus; and wherein the damping force applying device comprises: a rotary damper that changes a resistance magnitude according to a rotation speed; a magnetic clutch that controls whether to transmit the damping force applied to the shoulder rehabilitation apparatus in the direction opposite to the direction in which the force of the trainee is applied; a first coupler that connects the gravity compensating spring to a first shaft included within a spring shaft provided in the gravity compensation spring; a second coupler that is provided at a first side of the magnetic clutch and connects the first shaft and a second shaft; and a third coupler that connects the rotary damper and a third shaft connected to a second side of the magnetic clutch.

2. The damping-adjustable shoulder joint tracking apparatus according to claim 1, wherein the magnetic clutch comprises:

a clutch coil that is an electromagnet which connects the second shaft and the third shaft when power is supplied to the magnetic clutch; and a friction plate that generates a frictional force when the second shaft and the third shaft are connected by the clutch coil, wherein the magnetic clutch is divided into a first portion to which the second shaft is connected and a second portion to which the third shaft is connected.

3. The damping-adjustable shoulder joint tracking apparatus according to claim 2, wherein when the power is not supplied to the magnetic clutch, the second shaft and the third shaft are not connected and rotate independently, and wherein when the power is supplied to the magnetic clutch, the second shaft and the third shaft are connected and rotate at a same speed and in a same direction so that damping applied to the third shaft is transmitted to the second shaft to apply the damping force to the damping force applying device.

4. The damping-adjustable shoulder joint tracking apparatus according to claim 1, wherein the gravity compensation spring is implemented as a constant load spring.

5. The damping-adjustable shoulder joint tracking device according to claim 4, wherein the shoulder rehabilitation apparatus provided with the damping force applying device comprises:

a vertical frame formed vertically on ground;

a horizontal frame connected to the vertical frame at an angle of 90 degrees to be horizontal to the ground;

a first linear motion (LM) guide that is provided at a position opposite to the vertical frame provided with the gravity compensating spring and compensates for a vertical movement according to a motion of the shoulder joint of the trainee;

a compensation load transmitting cable that connects the gravity compensating spring and the first LM guide; and a second LM guide that compensates for a horizontal movement of the first shoulder joint according to an arm motion of the trainee, wherein the damping force applying device is provided at a position where the horizontal frame and the vertical frame are in contact.

6. A damping-adjustable shoulder joint tracking apparatus comprising:

a gravity compensation spring that is provided at a first point of a shoulder rehabilitation apparatus, and compensates for a vertical movement of a shoulder joint of a trainee, a weight of an arm, and gravity to a weight of a rehabilitation exercise device attached to the arm;

a vertical damping force applying device that is provided at a second point of the shoulder rehabilitation apparatus, is connected to the gravity compensation spring, and transmits damping corresponding to a force applied by the trainee in a vertical direction to the shoulder rehabilitation apparatus; and a horizontal damping force applying device that is provided at a third point of the shoulder rehabilitation apparatus and transmits damping corresponding to the force applied by the trainee in a first direction and second direction to the shoulder rehabilitation apparatus; wherein the vertical damping force applying device comprises: a rotary damper that changes a resistance magnitude according to a rotation speed; a first coupler that connects the gravity compensating spring to a first shaft included within a spring shaft provided in the gravity compensation spring; a second coupler that is provided at a first side of a magnetic clutch and connects the first shaft and a second shaft; and a third coupler that connects the rotary damper and a third shaft connected to a second side of the magnetic clutch.

7. The damping-adjustable shoulder joint tracking apparatus according to claim 6, wherein the horizontal damping force applying device comprises:

a first damping force applying device that is provided at a first direction LM guide of the shoulder rehabilitation apparatus and transmits the damping in the first direction; and a second damping force applying device that is provided at a second direction LM guide of the shoulder rehabilitation apparatus and transmits the damping in the second direction, and wherein the shoulder rehabilitation apparatus comprises:

a vertical frame formed vertically on ground;

a horizontal frame connected to the vertical frame at an angle of 90 degrees to be horizontal to the ground;

the first direction LM guide that is provided at one side of the vertical frame which is not provided with the vertical damping force applying device, and compensates for a movement in the first direction of the shoulder joint of the trainee; and the second direction LM guide that is provided in a direction of 90 degrees to the first direction LM guide, and compensates for a movement in the second direction of the shoulder joint of the trainee.

8. The damping-adjustable shoulder joint tracking apparatus according to claim 7, wherein each of the first damping force applying device and the second damping force applying device comprises:

a rotary damper that changes a resistance magnitude according to a rotation speed;

a magnetic clutch that controls whether to transmit a damping force applied to the shoulder rehabilitation apparatus in a direction opposite to a direction in which a force of the trainee is applied; and a timing belt that is connected to the magnetic clutch through a first shaft and converts a force of the rotary damper in a linear direction.

9. The damping-adjustable shoulder joint tracking apparatus according to claim 8, wherein each of the first damping force applying device and the second damping force applying device further comprises:

a coupler that connects the rotary damper to a second shaft connected to the magnetic clutch; and a pulley that fixes one side of the timing belt to the first direction LM guide or the second direction LM guide.

* * * * *